US005540075A

United States Patent [19]

Hall, Jr.

[11] Patent Number: 5,540,075

[45] Date of Patent: Jul. 30, 1996

[54] METHOD AND APPARATUS FOR SHOCK RELEASE OF THIN FOIL MATERIALS

[75] Inventor: Herbert L. Hall, Jr., Newark, Ohio

[73] Assignee: Owens-Corning Fiberglas Technology, Inc., Summit, Ill.

[21] Appl. No.: 238,992

[22] Filed: Oct. 25, 1994

[51] Int. Cl.[6] ..... B21D 22/12

[52] U.S. Cl. ..... 72/60; 72/63

[58] Field of Search ..... 72/54, 60, 63

[56] References Cited

U.S. PATENT DOCUMENTS

| | | | |
|---|---|---|---|
| 2,385,083 | 9/1945 | Kemerer | 72/63 |
| 2,745,173 | 5/1956 | Janos . | |
| 3,222,902 | 12/1965 | Brejcha et al. | 72/63 |
| 4,748,837 | 6/1988 | Kurosawa et al. | 72/63 |
| 5,090,981 | 2/1992 | Rusek, Jr. . | |
| 5,094,899 | 3/1992 | Rusek, Jr. . | |
| 5,376,424 | 12/1994 | Watanabe . | |

FOREIGN PATENT DOCUMENTS

| | | | |
|---|---|---|---|
| 1023051 | 3/1953 | France | 72/63 |
| 80130 | 3/1990 | Japan | 72/63 |

*Primary Examiner*—David Jones
*Attorney, Agent, or Firm*—Ted C. Gillespie; C. Michael Gegenheimer; Curtis B. Brueske

[57] ABSTRACT

A method is provided for releasing a thin foil workpiece from adherence with a resilient surface to which it adheres due to compression occurring in a forming operation. The method includes the steps of applying pneumatic pressure greater than ambient pressure between the first forming element and the workpiece while the workpiece remains held by compression. Thereafter, a second surface of a second forming element is separated from contact with the thin foil workpiece, removing compression, and rapid or shock release of the thin foil workpiece from its adherence to the resilient surface ensues. An alternative method is further provided.

18 Claims, 4 Drawing Sheets

METHOD AND APPARATUS FOR SHOCK RELEASE OF THIN FOIL MATERIALS

TECHNICAL FIELD

This invention relates to the forming of thin foil sheet materials and, more specifically, to a method and apparatus for releasing thin foils from elastomeric and resilient surfaces brought into firm contact with the foil material at some point during forming operations.

BACKGROUND OF THE INVENTION

Moderately high forming pressures and clamping forces are required to form thin foil sheet materials, particularly for low temperature forming, stamping and pressing operations. Such operations are hereafter referred to collectively as forming operations. Many of these forming operations use elastomeric or resilient surfaces in compression with the thin foil workpiece. Such surfaces include natural or synthetic rubber, polyurethane, filled cork, and other conventional elastomeric or resilient surfaces, hereafter generally referred to as resilient surfaces.

Wherever these pressures and forces bring a foil workpiece and resilient surfaces together, air is expelled from between the two, much like during compression of a suction cup. Because foils are compliant, air cannot easily re-enter the tight space between the foil and the resilient surface. After the forming operation is complete, the foil is left firmly adhered to the resilient surface and is often damaged during the process of its removal. This occurs whether large surface areas or annular or peripheral areas of the foil materials are compressed against the resilient surface.

Conventional forming operations such as hydroforming and rubber pad forming overcome these difficulties by sandwiching the thin foil between thicker sheets of steel. Heavier gauges of metal sheet materials such as steel can withstand the peel back force typically encountered with rubber diaphragms and pads. Since the steel plate(s), commonly referred to as cull plates, are formed along with the thin foil, they are not reusable and consequently exact a cost penalty in production.

Accordingly, improvements in forming thin foil sheet materials are needed to produce more cost effective shapes and products using thin foil materials.

SUMMARY OF THE INVENTION

The present invention satisfies that need with a method and apparatus which uses pneumatic pressure in combination with clamping pressure to provide "shock release" of a thin foil workpiece from resilient surfaces. During forming processes, foil thickness sheets of metal material, i.e. workpieces, adhere at first contact areas to resilient surfaces due to compression therewith needed to clamp the workpiece during forming. Separation of a thin foil workpiece from a resilient surface utilizing pneumatic pressure as taught herein is referred to as "shock release" as separation occurs quickly. Otherwise, complete release does not occur.

In accordance with the present invention, shock release of a workpiece is accomplished by first applying pneumatic pressure between the thin foil workpiece and the first forming element inward from the periphery of the first contact area while the workpiece remains in compression. The next step is to separate from contact with the thin foil workpiece a second surface which maintains the workpiece in compression. Shock release of the workpiece then occurs due to the pneumatic pressure applied. Alternatively, shock release may be accomplished by first releasing the pressure on the workpiece, that is, by initiating separation of the first resilient surface and opposing second surface; and then rapidly supplying pneumatic pressure between the foil workpiece and first forming element at a point inward from the periphery of the first contact area. Continuing to separate the second surface from contact with the foil workpiece results in rapidly releasing, i.e. shock release, of the thin foil workpiece from the first resilient surface.

The method and apparatus of the present invention may also be performed with forming processes which use a resilient pad, bladder, or diaphragm. Theses processes further present a resilient forming surface for forming a workpiece by compressing and forming a second contact area of the workpiece. Where these processes are used, shock release is applied by first supplying pneumatic pressure between the second contact area of the workpiece and the resilient forming surface. Complete release of the thin foil workpiece becomes a two step process. The second contact area is first released, followed by release of the first contact area.

The method of the present invention achieves rapid workpiece removal from resilient surfaces in forming elements. Higher production rates become possible with thin foil workpieces. Damage to formed thin foil workpieces during removal by conventional mechanical or manual techniques is avoided. Accordingly, methods conventionally using cull plates to ensure workpiece separation from the forming elements may be simplified, and waste due to use and disposal of cull plates is eliminated. In addition, the need for additional pressure to form the cull plates concurrently with the thin foil workpiece is avoided, reducing power costs, tooling wear, and cycle times. The present invention, thus, provides lower production costs for parts and products made from thin foil materials by simplifying manufacturing procedures, boosting production rates, and reducing the material, tooling, and energy needs of production.

These and other features and advantages of the present invention are disclosed in the drawings and detailed description which follow.

DETAILED DESCRIPTION OF THE PREFERRED EMBODIMENTS

Figure 1A:
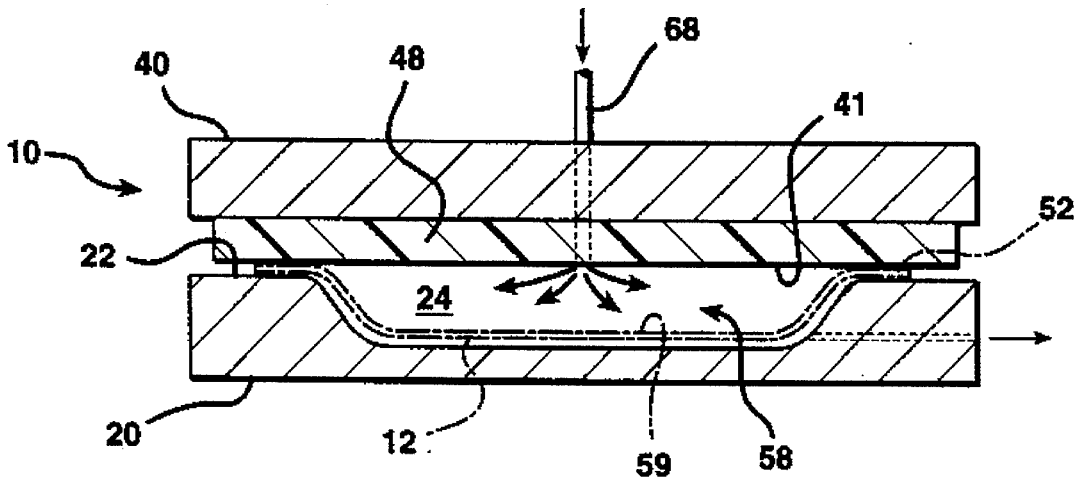
FIG. 1A is a schematic view in cross-section of the preferred embodiment of the present invention, with a representative forming cavity.

The apparatus 10 and method of the present invention may be used to "shock release" formed thin foil workpieces from adherence to elastomeric or resilient surfaces 41 compressed thereagainst during forming, as representatively shown in FIGS. 1A through 3D.

Referring to FIGS. 1A–3D, first and second forming elements, 40 and 20, respectively, are representatively shown as used to form a foil workpiece 12 placed therebetween. As shown, the thin foil workpiece 12 includes a first contact area 52 which is in compression with a first resilient surface 41 of the first forming element 40, positioned between the surface 41 and an opposing second surface 22. The terms, first and second forming elements, are used broadly to describe dies, molds, seal plates, stamping, blanking, and other forming tools on which the present invention may be practiced. The thin foil workpiece 12 released in accordance with the present invention may be formed into one or more forming cavities 24 in a forming element.

Figure 1B:
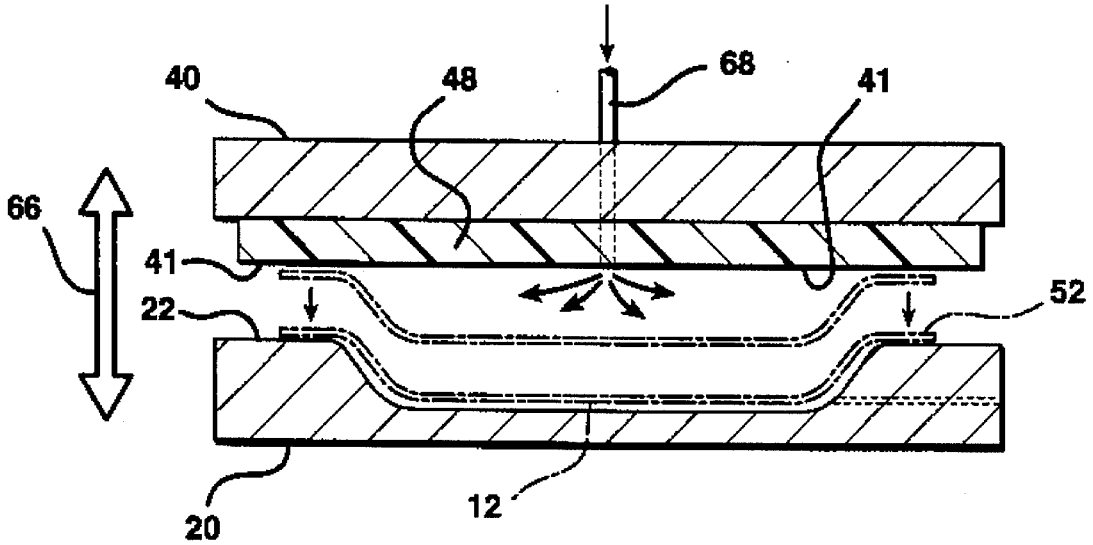
FIG. 1B is a schematic view in cross-section of the preferred embodiment of FIG. 1A in a second position releasing the workpiece.

Referring now to FIGS. 1A and 1B, in accordance with the present invention, a method is provided for releasing the thin foil workpiece 12 from contact with the resilient surface 41 to which it adheres due to compression occurring in a forming operation. The method includes the steps of applying pneumatic pressure greater than ambient pressure between the first forming element 40 and the thin foil workpiece 12 while the workpiece 12 remains in compression, as shown in FIG. 1A. The pneumatic pressure is applied inward from the periphery of the first contact area 52, and may be established by air, nitrogen, or other working gas introduced through gas supply way 68 or other passage or tube configured to provide the desired flow of gas. Thereafter, the second surface 22 is separated from contact with the foil workpiece 12, removing the compression of the first contact area 52. Shock release of the thin foil workpiece 12 ensues as it rapidly releases from adherence to the first resilient surface 41, as indicated by the small arrows in FIG. 1B.

It has been found that in performing this method, separating the second surface 22 from the thin foil workpiece 12, or stated alteratively, from the first resilient surface 41, is preferably performed at a speed of at least about 5 inches per minute. Such separation is indicated by the arrow 66 in FIG. 1B. The speed of separation may vary faster or slower depending on the application, and depending on the particular first and second forming surfaces being used. Some trial and error may be required to establish the minimum opening speed to accomplish rapid release of the thin foil workpiece 12 in a particular case. Regardless, once shock release has occurred, it is advantageous to have a drive device which allows more rapid separation of the first and second forming elements 40, 20 to minimize cycle time.

As may be further understood from FIGS. 1A and 1B, an alternative method for releasing the thin foil workpiece 12 from contact with the resilient surface 41 is provided including the steps of first releasing compression between the first resilient surface 41 and the second surface 22 by initiating separation therebetween. The first contact area 52, of course, remains adhered to the resilient surface 41. Thereafter, pneumatic pressure greater than ambient pressure is rapidly supplied between the thin foil workpiece 12 and the first forming element 40 inward from the periphery of the contact area 52, rapidly achieving a pneumatic pressure level therein greater than ambient pressure. The method next calls for continuing to separate the second surface 22 from contact with the foil workpiece 12, and rapid shock release of the thin foil workpiece 12 from the first resilient surface 41. The steps of initiating separation and continuing separation are preferably performed in a continuous, uninterrupted motion or sequence.

In either method, in releasing the workpiece 12, the entire periphery of the first contact area 52 is rapidly removed from adherence to the first resilient surface 41. If the first contact area 52 were only partially released or slowly released, the pneumatic pressure would bleed down, without the desired effect. While the entire periphery is not simultaneously released, but rather begins at one portion and rapidly "unzips" around the first contact area, the release occurs so fast it appears to be substantially simultaneously. Thus, the term, "shock release" is used. Where partial release occurs, and the thin foil workpiece 12 remains adhered to the resilient surface 41, it has been found that escaping gas from volume 58 often establishes vibration at the edge of the foil material as the gas rushes past. Such motion causes workhardening and failure of the affected portion of the workpiece.

To ensure complete release, either method may further include continuously supplying pneumatic pressure while separating the second surface and rapidly releasing the thin foil workpiece. It is preferred in practicing the present invention to supply pneumatic pressure in the range from about 2.4 bar (35 pounds per square inch absolute [psia]) to about 8 bar (115 psia). Higher pressures are possible, but when overpressure occurs, the impact of release can damage the formed part and provide a personnel hazard.

Figure 2A:
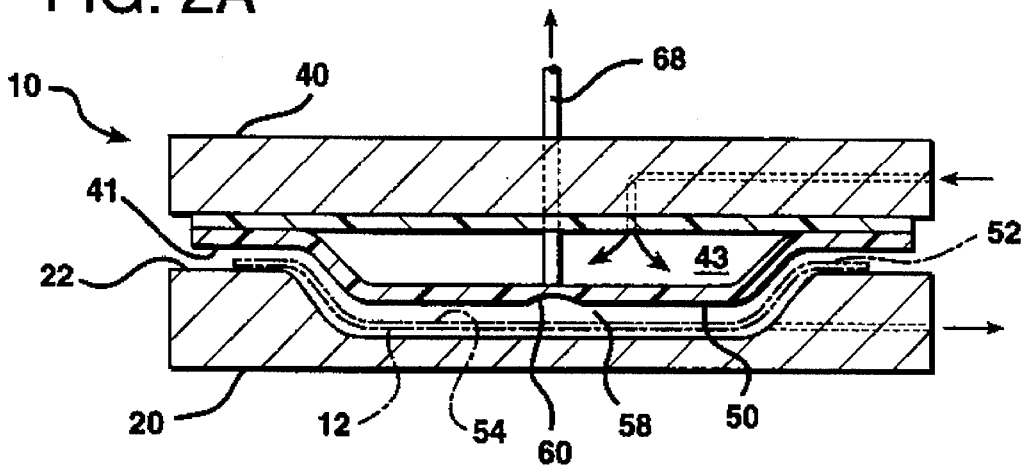
FIG. 2A is a schematic view in cross-section of an alternative embodiment of the present invention in an alternative forming device.
Figure 3A:
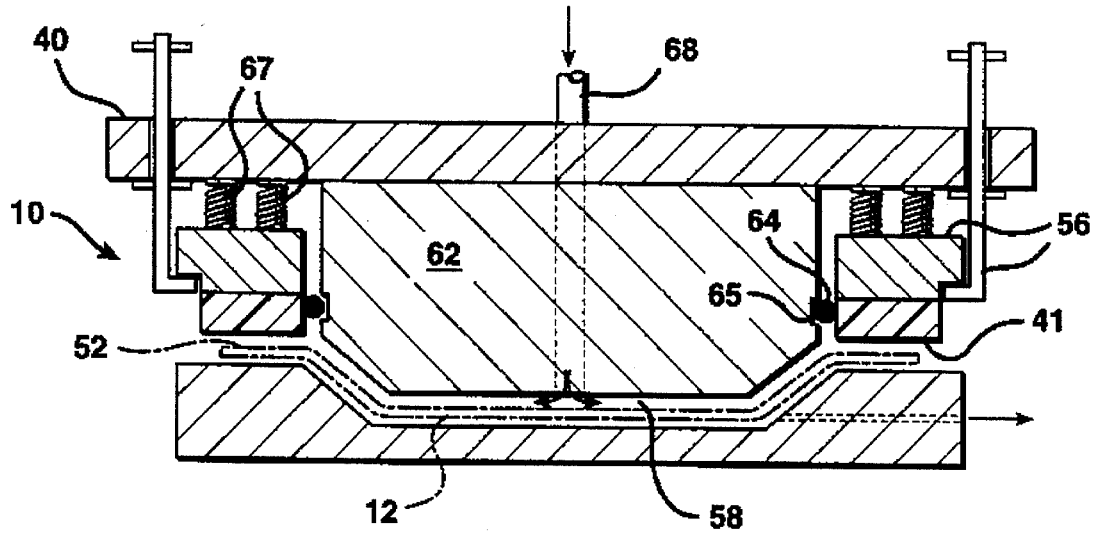
FIG. 3A is a schematic view in cross-section of an alternative embodiment of the present invention in an alternative forming device.

As shown in FIGS. 1A, 2A, and 3A, where like numbers refer to like elements, where the first contact area 52 generally surrounds at least one volume 58 between the thin foil workpiece 12 and the first forming element 40, the step of supplying pneumatic pressure pressurizes the volume 58, and the pressure is evenly applied across the surface of the workpiece 12. This is best shown in FIG. 1A where the workpiece 12 is formed into a workpiece cavity 59 extending below and spaced from the first forming element 40, and the first contact area 52 is substantially the boundary of the volume 58.

Figure 2B:
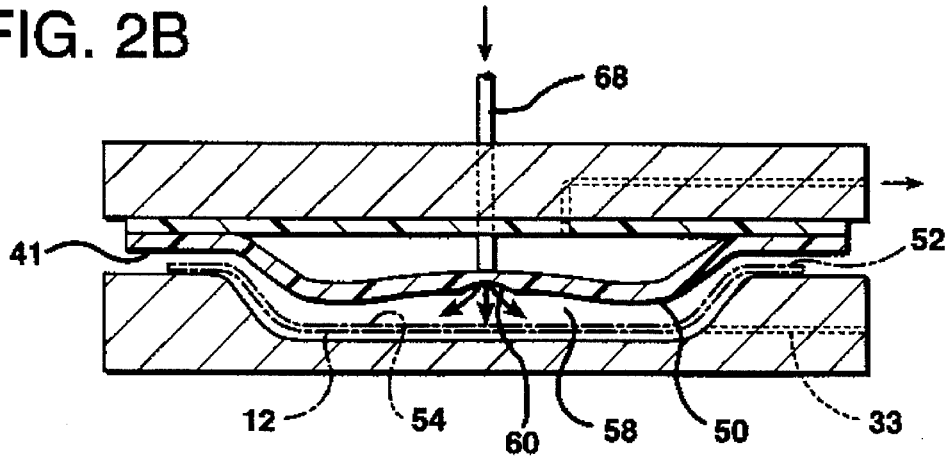
FIGS. 2B and 2C are schematic views in cross-section of the alternative embodiment of FIG. 2A in progressive positions releasing the workpiece.
Figure 2C:
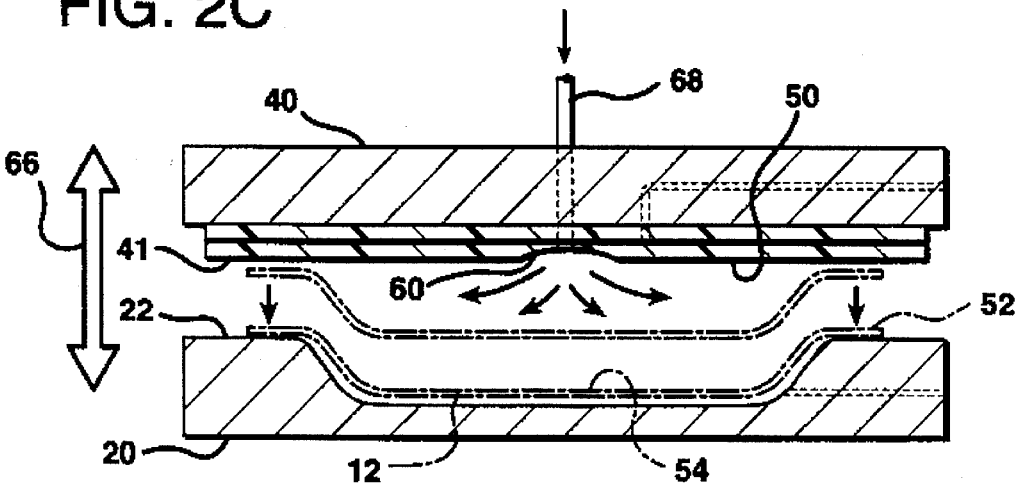

As further representatively shown in FIGS. 2A–2C, the first resilient surface 41 may include a resilient forming surface 50, for example a bladder 43 inflatable by conventional means (not shown), or diaphragm (not shown), or pad (not shown). In such an alternative forming device, at least one portion of the workpiece 12 is a second contact area 54 in compression with the resilient forming surface 50. The resilient forming surface 50 could be a separate surface from, an extension of, or the same as, the first resilient surface 41. In such a device, in accordance with the present invention, the step of supplying pneumatic pressure is performed by supplying pneumatic pressure inward from the periphery of the second contact area 54. The step of rapidly releasing the thin foil workpiece 12 from the first resilient surface 41 becomes a two step process, first releasing the second contact area 54 of the thin foil workpiece 12 from the resilient forming surface 50, and then releasing the first contact area 52 of the thin foil workpiece 12 from the first resilient surface 41. Once the second contact area 54 is released, the first contact area 52 may be released by either first applying pneumatic pressure while the first contact area 52 is under compression, and then separating the first and second surfaces 41, 22; or by initiating separation of those surfaces 41, 22, and then rapidly applying pneumatic pressure, as previously set forth.

Regardless, it is preferred in practicing the method with a device as representatively shown in FIGS. 2A–2C, that the resilient forming surface 50 includes a concave portion 60 which defines part of the volume 58.

As further representatively shown in FIGS. 3A–3D, the present invention may be applied to a mechanical forming method, such as a stamping or blanking operation. As representatively shown, the first resilient surface 41 is a ring shape, mounted to move relative to other portions of the first forming element 40, such as stamping element 62. As shown, the stamping element 62 shapes the thin foil workpiece 12, while the first resilient surface 41 clamps against first contact area 52 to retain the workpiece 12. An o-ring 64 in retaining groove 65 representatively seals the stamping element 62 with a sliding seal against the sliding structure 56 supporting the first resilient surface 41. Pneumatic pressure supplied through the gas supply way 68 is thereby retained in volume 58. Alternative conventional sliding seals, such as a lip seal, are possible, and the particular seal type is not critical to the present invention. As well, while springs 67 are representatively shown, they may alternately be air or hydraulic cylinders, rubber blocks, or like compressible elements.

Figure 3B:
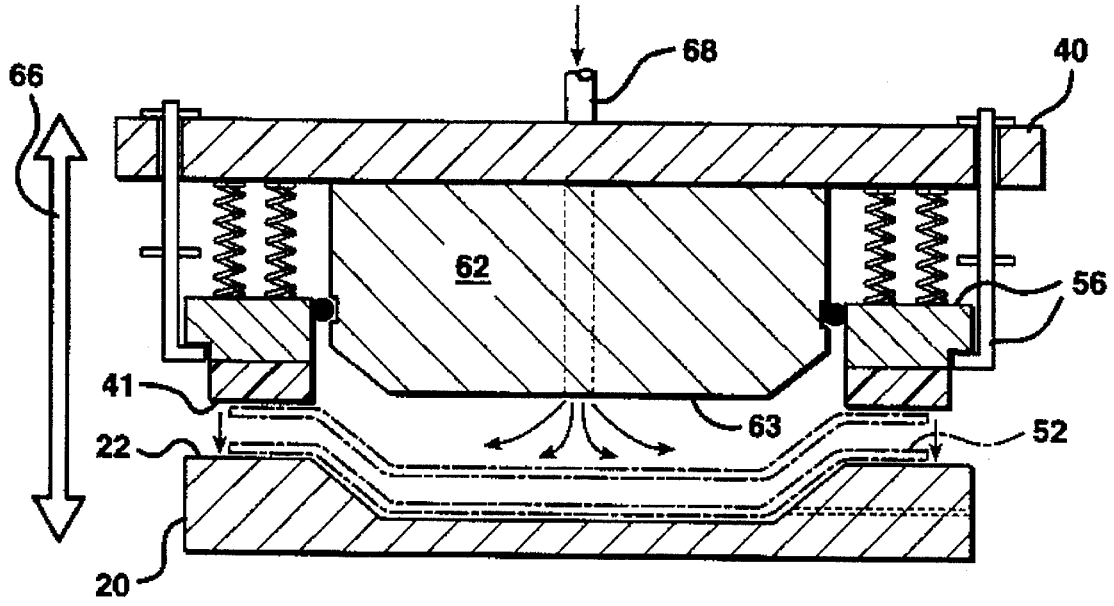
FIG. 3B is a schematic view in cross-section of the alternative embodiment of FIG. 3A in a second position releasing the workpiece.

In accordance with the method of the present invention practiced in the embodiment of FIGS. 3A-3B, the method may again be performed to release the first contact area 52 by either first applying pneumatic pressure to volume 58 while the first contact area 52 is under compression, and then separating the first and second surfaces 41, 22; or by initiating separation of those surfaces 41, 22, and then rapidly applying pneumatic pressure to volume 58. In either case, as shown in FIG. 3B, the method may optionally include the step of retracting, partially or completely, the stamping element 62 before or during the step of applying pneumatic pressure to the volume 58. The object of the present invention, however, remains the same, to achieve a sudden and complete shock release of the thin foil workpiece 12 from the resilient surface 41.

As may be understood from the above, many other variations and types of forming devices may employ the method of the present invention and its variants. By way of example, not limitation, an elastomeric sheet (such as shown in FIGS. 1A and 1B) or bladder (such as shown in FIGS. 2A–2C) may be applied to the end 63 of the stamping element 62. In this case, the two step release method of the present invention described above with regard to the device of FIGS. 2A–2C may be employed.

Figure 3C:
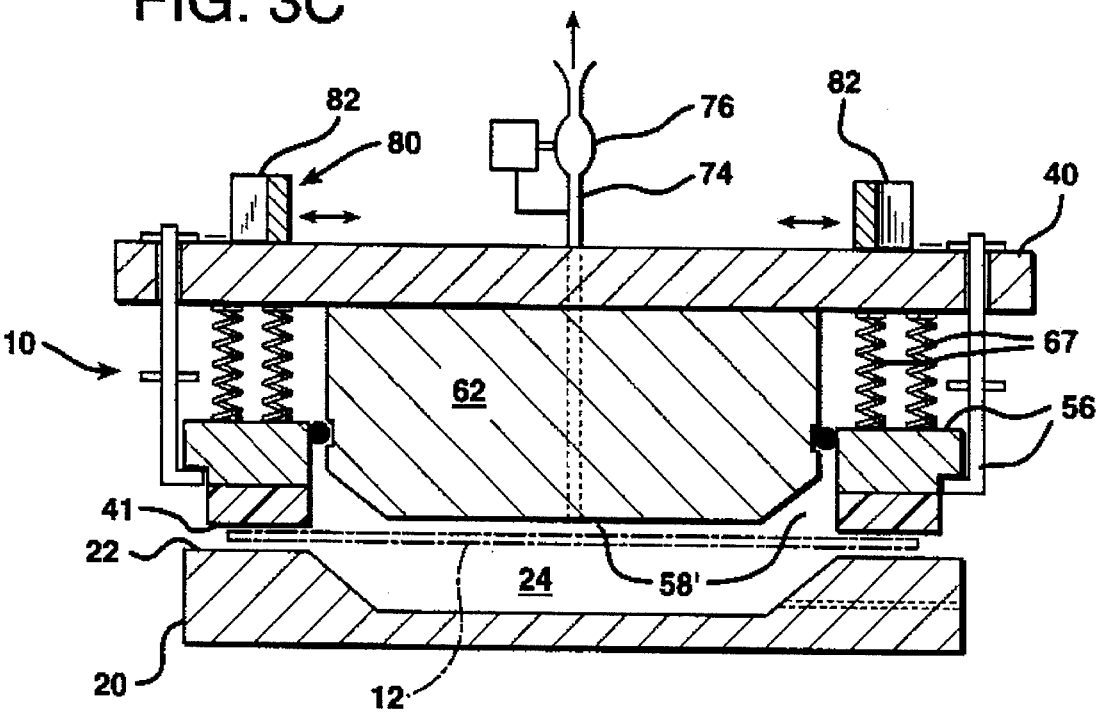
FIG. 3C is a schematic view in cross-section of an alternative configuration for the embodiment of FIG. 3A, in a first position.
Figure 3D:
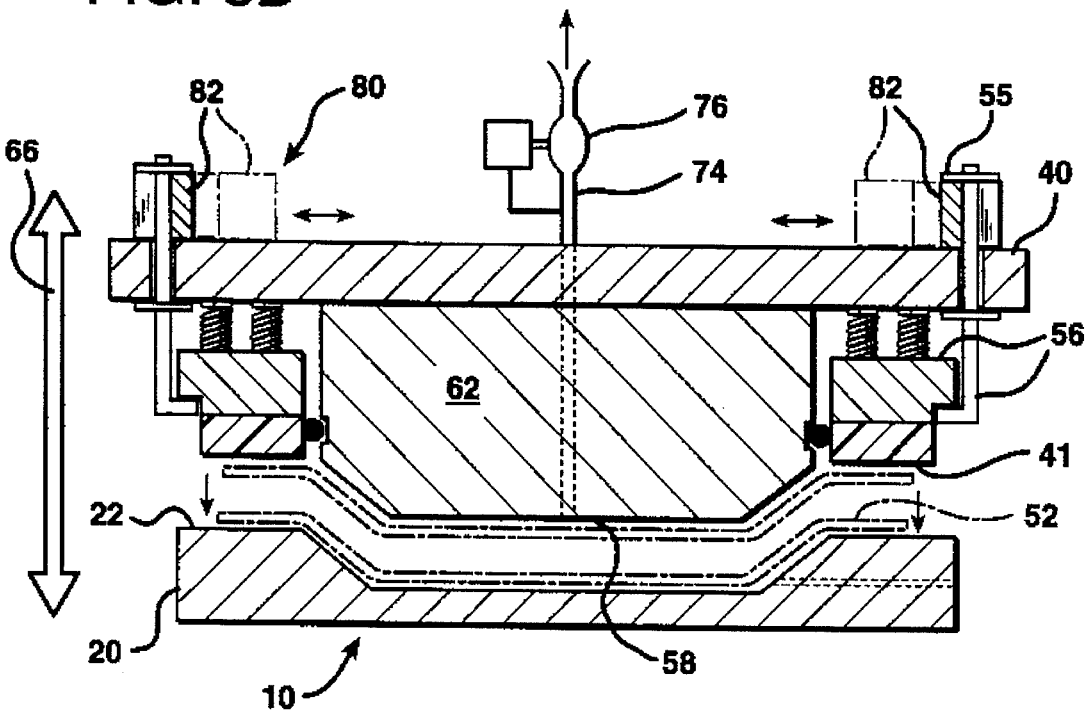
FIG. 3D is a schematic view in cross-section of the alternative configuration of FIG. 3C, in a second position releasing the workpiece.

Referring now to FIGS. 3C and 3D, a further configuration is shown in which pneumatic pressure is not supplied to the volume 58 as shown in FIG. 3B, but rather is developed by compression of captured or residual gas present in initial volume 58' at the outset of forming, as shown in FIG. 3C. As understood from FIG. 3D, when stamping element 62 forms thin foil workpiece 12 into the forming cavity 24, a volume 58 smaller than volume 58' results, and pneumatic pressure in volume 58 rises. As a function of geometry, the size of initial volume 58' can be designed to produce desired pressures in volume 58, which can then serve to provide shock release of the formed workpiece upon removing second clamping surface 22 from contact with workpiece 12. As shown in FIG. 3D, to achieve this end, the sliding structure 56 is locked in place with locking device 80 to maintain the pneumatic pressure in volume 58. Separating the first and second forming elements 40, 20 causes shock release of the thin foil workpiece 12.

Applicable to the configuration of FIGS. 3C and 3D, a representative locking device 80 is shown which includes a u-shaped block 82 which may be slidably positioned by a solenoid (not shown) beneath first stop 55 to lock the sliding structure 56 in a retracted position to enable shock release to follow after forming. The u-shaped block 82 may be removed as shown in FIG. 3C (and in phantom in FIG. 3D) to allow return of the sliding structure 56 to an initial position. Many alternative locking devices are possible which will perform the desired function, and the precise structure of locking device 80 is not critical to the present invention. Although the locking device 80 shown has two discrete positions (locking or unlocking), other forms of the locking device may be provided having continuous positioning, such as a screw drive (not shown) or a ratchet drive device (not shown), and may be further used to lock or position the first resilient surface 41 in intermediate positions during the forming cycle, if desired.

Still referring to FIGS. 3C and 3D, a vent line 74 and an adjustable pressure control valve 76 may be further provided for overpressure relief and to control pneumatic pressure in volume 58 to a desired level, preferably in the range from about 2.4 bar (35 pounds per square inch absolute [psia]) to about 8 bar (115 psia).

With reference to FIGS. 2A–3D, it is understood that thin foil workpieces 12 including small holes, cut-outs and the like present may be formed (e.g. by bladder 43 or stamping element 62) in forming cavity 24. To practice the shock release method of the present invention on such workpieces requires that any such small holes, cut-outs and the like be sealed with tape or other sealing material which can withstand pressures in volume 58 at least in the range from about 2.4 bar (35 pounds per square inch absolute [psia]) to about 8 bar (115 psia). In FIG. 2B, shock release of just the second contact area 54 may be possible even without use of tape or other sealing material by blocking forming vent 33 with a valve (not shown). However, application of the present invention to completely release the workpiece is preferred.

The actual forming process and device on which the present invention is practiced may, thus, be one of any number of conventional processes wherein an elastomeric or resilient surface 41, is compressed in contact with at least one portion of a thin foil workpiece 12. These processes include, by way of further example, and not limitation, such forming operations as stamping operations, hydroforming, and rubber pad forming. In addition, the present invention may be applied to blanking operations, where resilient surfaces are compressed in contact with a thin foil workpiece 12. For example, in like fashion as in FIGS. 3A and 3B, the stamping element 62 could be a blanking element, with or without a forming cavity 24 in the opposing second element.

Referring now to FIGS. 1A and 1B, the present invention is shown as applied to a preferred, novel pneumatic forming process, set forth in greater detail in a related case, commonly owned and assigned to the same assignee as the present application, being U.S. patent application Ser. No. 08/238,991, filed Jun. 4, 1994, by Hall et al, entitled Method and Apparatus for Pneumatic Forming of Thin Foil Materials, and incorporated herein by reference. In the preferred embodiment, the first forming element 40 preferably includes a resilient surface 41 which is a generally planar elastomeric sheet 48, and the pneumatic pressure applied between the first forming element 40 and the thin foil workpiece 12 is between the elastomeric sheet 48 portion of the element 40 and the workpiece 12.

The preferred elastomeric sheet 48 or other first resilient surface 41 provided as a resilient sheet has significant operational and cost advantages. As shown in FIGS. 1A–2C, the use of sheet as the first resilient surface 41 removes the need for costly precision alignment between the opposing first and second forming elements 40, 20, such as is required for matched metal dies. As well, the opposing second surface need not be machined to the same precision as matched metal dies, as the resilient sheet conforms to any small irregularities, warping and deviations in planarity. Thus, slight misalignment or deviation from planarity between the opposing first resilient and second surfaces 41, 22 becomes operationally insignificant. Tooling costs are significantly reduced, and change of worn tooling can be accomplished readily without need for exacting and expensive alignment. As well, the operational life of the first resilient surface 41 can be extended by adjusting the position of the first resilient surface 41 relative to the second clamping surface 22 so that wear can be distributed over the first resilient surface 41. In addition, premature replacement due to compression set from repeated operation against the same portion of the first resilient surface 41 can be avoided.

A preferred application of the present invention is to the release of thin foil workpieces 12 formed in accordance with a pan-forming operation on metal workpieces, such as steel or stainless steel workpieces, of 0.0254 cm (0.01 inches) thickness or less, as taught in U.S. patent application Ser. No.08/238,991, incorporated by reference above.

Regardless of the process or forming device, the resilient surfaces 41 from which a thin foil workpiece 12 may be released in accordance with the present invention include conventional elastomeric or resilient materials typical of forming operations, such as natural or synthetic rubber, polyurethane, and filled cork.

In a further aspect of the present invention, an apparatus 10 is provided for releasing a thin foil workpiece 12 from adherence at first contact areas 52 to a resilient surface 41 due to compression occurring during a forming operation. As shown in FIGS. 1A–3B, the apparatus 10 includes a first forming element 40 including a first resilient surface 41 to receive at least one portion of a thin foil workpiece 12 which is first contact area 52. The apparatus 10 further includes a second forming element 20 having a second surface 22 to receive at least one portion of a thin foil workpiece 12 in opposing relationship with the first contact area 52. The first and second forming elements 40 and 20 are moveable into clamping relationship with respect to each other, so that the first contact area 52 of a workpiece 12 is in compression between at least a portion of the first resilient surface 41 and the second surface 22. It is understood that the second surface could be a die surface in the second forming element 20, as shown in FIGS. 1A–3B, or alternatively a cull plate, insert plate, die surface, or other element (not shown) introduced in a particular process or device against which the workpiece 12 is formed.

A shown in FIGS. 1A–3B, a gas supply way 68 is connected to a source of pneumatic pressure (not shown) greater than ambient pressure (14.7 psia). The gas supply way 68 is connected to quickly convey gas to between the thin foil workpiece 12 and the first forming element 40 to a point inward from the periphery of the first contact area 52. Pneumatic pressure is caused to develop in a volume 58 sealed by adherence of the workpiece 12 to the resilient surface 41. The first forming element 40 may further include a component part such as sheet 48 (FIG. 1A), bladder 43 (FIG. 2A) or stamping element 62 (FIG. 3A) exposed to the pneumatic pressure which develops in volume 58. The apparatus 10 further includes a drive device indicated generally by arrow 66, for separating the first and second surfaces 41, 22 from clamping relationship. The structure of the drive device is irrelevant for purposes of the invention, and may be any of several commercially available devices which may be applied to move at least one element. The opening rate may vary somewhat with the particular forming elements being used in an application of the present invention. What will remain, however, in practicing the present invention, is that the pneumatic pressure in the volume 58 is at desired levels to produce shock release at the moment the second forming element 40 finally releases the thin foil workpiece 12 from compression.

While certain representative embodiments and details have been shown for purposes of illustrating the invention, it will be apparent to those skilled in the art that various changes in the method and apparatus disclosed herein may be made without departing from the scope of the invention, which is defined in the appended claims.

I claim:

1. A method for releasing a thin foil workpiece from contact with a resilient surface in a forming operation, wherein at least one portion of a thin foil workpiece comprises a first contact area in compression with a first resilient surface of a first forming element and positioned between said first forming element and a second surface, said method comprising:

supplying pneumatic pressure greater than ambient pressure between said thin foil workpiece and said first forming element inward from the periphery of said first contact area while said workpiece remains in compression;

thereafter separating the second surface from contact with the foil workpiece; and rapidly releasing said thin foil workpiece from said first resilient surface with pneumatic pressure between said thin foil workpiece and said first forming element.

2. The method of claim 1 wherein said step of rapidly releasing comprises rapidly releasing the entire periphery of said first contact area.

3. The method of claim 1 wherein the step of supplying pneumatic pressure is performed continuously while performing said steps of separating and rapidly releasing.

4. The method of claim 1 wherein said first contact area generally surrounds at least one volume between said thin foil workpiece and said first forming element, and said step of supplying pneumatic pressure pressurizes said volume.

5. The method of claim 4 wherein:

said workpiece is formed into a cavity extending below and spaced from said first forming element, said first contact area substantially comprises the boundary of said cavity; and said step of rapidly releasing comprises releasing said boundary around said cavity.

6. The method of claim 4 wherein:

said first resilient surface further comprises a resilient forming surface, and at least one portion of the workpiece comprising a second contact area is in compression with said resilient forming surface, and:

said step of supplying pneumatic pressure further comprises supplying pneumatic pressure inward from the periphery of said second contact area; and said step of rapidly releasing said thin foil workpiece from said first resilient surface comprises two steps including:

releasing said second contact area of said thin foil workpiece from said resilient forming surface; and releasing said first contact area of said thin foil workpiece from said first resilient surface.

7. The method of claim 1 wherein said step of supplying pneumatic pressure is performed by supplying pneumatic pressure in the range from about 2.4 bar to about 8 bar.

8. The method of claim 1 wherein said step of separating comprises separating the first and second surfaces at a speed of at least about 5 inches per minute.

9. The method of claim 1 wherein said thin foil workpiece comprises a metal workpiece having a thickness less than 0.0254 centimeters.

10. The method of claim 9 wherein said forming operation comprises an operation forming a pan shape having at least one flange.

11. The method of claim 1 wherein:

said step of supplying pneumatic pressure comprises supplying pneumatic pressure between said thin foil workpiece and said first resilient surface inward from the periphery of said first contact area; and said step of rapidly releasing comprises rapidly releasing said thin foil workpiece from said first resilient surface with pneumatic pressure between said thin foil workpiece and said first resilient surface.

12. The method of claim 11 wherein said first contact area generally surrounds at least one volume between said thin foil workpiece and said first resilient surface of said first forming element, and said step of supplying pneumatic pressure pressurizes said volume.

13. The method of claim 12 wherein:

said thin foil workpiece comprises a metal workpiece having a thickness less than 0.0254 centimeters; and said forming operation comprises a pan forming operation.

14. A method for releasing a thin foil workpiece from contact with a resilient surface in a forming operation, wherein at least one portion of a thin foil workpiece comprises a first contact area in compression with a first resilient surface of a first forming element and is positioned between said first forming element and a second surface, said method comprising:

releasing compression between the first resilient surface and the second surface by initiating separation therebetween;

thereafter rapidly supplying pneumatic pressure greater than ambient pressure between said thin foil workpiece and said first forming element inward from the periphery of said first contact area, and rapidly achieving a pneumatic pressure therein greater than ambient pressure;

continuing to separate the second surface from contact with the foil workpiece; and rapidly releasing said thin foil workpiece from said first resilient surface with pneumatic pressure between said thin foil workpiece and said first forming element.

15. The method of claim 14 wherein the step of rapidly supplying pneumatic pressure is performed continuously while performing said steps of continuing to separate and rapidly releasing.

16. The method of claim 14 wherein the steps of releasing compression by initiating separation and continuing to separate are performed in an uninterrupted, generally continuous sequence.

17. A method for releasing a thin foil workpiece from contact with a resilient surface in a forming operation, wherein at least one portion of a thin foil workpiece comprises a first contact area in compression with a first resilient surface of a first forming element and positioned between said first forming element and a second surface, said method comprising:

initially capturing a supply of gas in an initial volume defined between said thin foil workpiece and said first forming element inward from the periphery of said first contact area prior to compression of said workpiece;

developing pneumatic pressure greater than ambient pressure during forming of said workpiece which reduces said initial volume to a smaller volume;

maintaining said pneumatic pressure in said smaller volume while said workpiece remains in compression at said first contact area;

thereafter separating the second surface from contact with the foil workpiece; and rapidly releasing said thin foil workpiece from said first resilient surface with pneumatic pressure between said thin foil workpiece and said first forming element.

18. The method of claim 17 wherein said first forming element includes a movable stamping element, and wherein said step of developing pneumatic pressure includes reducing said initial volume by moving said stamping element.

* * * * *